US005343586A

United States Patent [19]

Vosbikian

[11] Patent Number: 5,343,586

[45] Date of Patent: Sep. 6, 1994

[54] WINDOW CLEANING DEVICE

[75] Inventor: Peter S. Vosbikian, Moorestown, N.J.

[73] Assignee: Quickie Manufacturing Corporation, Cinnaminson, N.J.

[21] Appl. No.: 930,715

[22] Filed: Aug. 14, 1992

[51] Int. Cl.[5] ..... A47L 13/12; A47L 1/05

[52] U.S. Cl. ..... 15/121; 15/244.1; 15/245

[58] Field of Search ..... 15/100, 110, 111, 114, 15/115, 117, 118, 121, 173, 244.1, 244.3, 245

[56] References Cited

U.S. PATENT DOCUMENTS

| | | | |
|---|---|---|---|
| 26,862 | 4/1897 | Mayger | 15/244.1 |
| 684,592 | 10/1901 | Trost | 15/121 |
| 970,563 | 9/1910 | Schwalen | 15/121 |
| 1,117,513 | 11/1914 | North | 15/117 |
| 2,116,877 | 5/1938 | Brown | 15/245 |
| 2,580,814 | 1/1952 | Morley | 15/245 |
| 2,745,126 | 5/1956 | Mora | 15/121 |
| 2,904,806 | 9/1959 | Obergfell | 15/118 |
| 2,904,807 | 9/1959 | Obergfell | 15/245 |
| 3,008,163 | 11/1961 | Bommer | 15/118 |
| 3,724,017 | 4/1973 | Mallory | 15/121 |
| 3,789,451 | 2/1974 | Laitner | 15/118 |
| 4,050,111 | 9/1977 | Mallory | 15/232 |
| 4,122,771 | 10/1978 | Barton | 15/245 |
| 4,240,176 | 12/1980 | Farmer | 15/244.1 |
| 4,409,700 | 10/1983 | Sullivan | 15/245 |

FOREIGN PATENT DOCUMENTS

| | | | |
|---|---|---|---|
| 537184 | 4/1955 | Belgium | 15/121 |
| 584387 | 10/1959 | Canada | 15/121 |
| 642066 | 6/1962 | Canada | 15/121 |
| 956065 | 10/1974 | Canada | 15/121 |
| 409849 | 12/1974 | Fed. Rep. of Germany | 15/121 |
| 2002237 | 2/1969 | France | 15/244.1 |
| 16416 | 6/1902 | United Kingdom | 15/121 |
| 344619 | 3/1931 | United Kingdom | 15/121 |

*Primary Examiner*—David A. Scherbel
*Assistant Examiner*—Randall E. Chin
*Attorney, Agent, or Firm*—Eckert Seamans Cherin & Mellott

[57] ABSTRACT

An easily manufactured and inexpensive window cleaning device has identical upper and lower plates forming a head for receiving a sponge and a squeegee on opposite sides. The upper and lower plates have a horizontal section and opposite longitudinal edges. A radial clamping section of each plate is disposed at one longitudinal edge for clamping to the sponge. An L-shaped shoulder is disposed at the opposite edge, for engaging a complementarily shaped foundation spline of the squeegee, from which the blade of the squeegee protrudes. The two plates are of identical shape, being placed in mirror image position when attached together, for example using rivets that also attach a stem for receiving a handle. The sponge is secured within the radial sponge clamping section without the need of an internal stiffener, and the squeegee blade is oriented to an advantageous angle by the channel formed by the opposing L-shaped shoulders. The arrangement of the squeegee blade minimizes the extent of bending required to form the squeegee engaging section.

18 Claims, 2 Drawing Sheets

WINDOW CLEANING DEVICE

BACKGROUND OF THE INVENTION

1. Field of the Invention

This invention relates to cleaning tools for windows and the like, and in particular to a novel head for a cleaning tool having a sponge and squeegee, and a particular structure for securing the sponge and squeegee to the device.

2. Prior Art

Window cleaning devices are known with a sponge section for application of soapy water or some other cleaning or rinsing liquid to a smooth surface such as a window pane during cleaning, and a squeegee section for removal of the soapy water or liquid. The sponge and the squeegee blade typically are affixed on opposite sides of a head which is received on an elongated handle such as a broom stick or the like, enabling manual manipulation of the sponge and squeegee to effect window cleaning.

Prior art window cleaning devices having head portions holding a sponge and squeegee include U.S. Pat. Nos. 3,724,017 and 4,050,111, both to Mallory. The head section of Mallory '017 includes two plates which are affixed together to clamp the sponge and squeegee in operative position. A C-shaped elongated bottom plate has flanges at each of its longitudinal edges. A top C-shaped plate, similar but not identical to the bottom plate, is adapted for seating within the bottom plate. The top plate similarly is elongated and has flanges along each of its longitudinal edges. The sponge and the squeegee are trapped between the flanges of the plates at the respective longitudinal edges of the C-shaped plates, so as to face substantially in opposite directions on the tool.

The sponge protrudes approximately perpendicular to an axis of the tool handle. The longitudinal edge of the head for securing the squeegee blade, on the other hand, protrudes at an upward angle, as needed to position the blade at an angle relative to perpendicular, such that the blade passes at an angle over the glass or other surface to facilitate removal of liquid.

Over the useful life of the tool, a sponge of the type disclosed in Mallory '017 tends to pull out of the head portion of the device. Mallory '111 discloses an improvement intended to better retain the sponge in the head during use. Mallory '111 adds an internal stiffener or spine having an elongated body with a pair of ridges projecting outwardly from opposite sides of the body. The stiffener is placed in a narrow slit in the sponge. The stiffener has a spacer section integral to secondary ridges residing within a channel formed by the flanges of the assembled C-shaped head plates. The stiffener thereby anchors the sponge in the head assembly because the stiffener is locked in the sponge behind the flanges.

Mallory '111 also discloses a head portion having an upwardly angled longitudinal edge for clamping the squeegee blade to dispose the squeegee blade at an advantageous angle for removing liquids from glass or other smooth surfaces. Both Mallory '111 and Mallory '017, however, require non-identical head plates to achieve their objects.

The present invention seeks to overcome certain manufacturing disadvantages of the prior art such as represented by the Mallory patents. While retaining secure connection of the sponge and the correct angle of the squeegee, the invention avoids the need for a dissimilar head plates and the different dies and production steps needed to accommodate dissimilar head plates. The invention further eliminates the need for a stiffening bar for adequately securing a sponge portion to the head and the need to sharply angle the longitudinal squeegee clamping edge of the head in order to orient the squeegee blade at a suitable angle.

SUMMARY OF THE INVENTION

It is a general object of the invention to provide an easily manufactured window cleaning device which is inexpensive and durable.

It is another object of the invention to provide a window cleaning device having opposed plates for securing a sponge and a squeegee, which has identical plates for the head of the device and which requires no other components other than the plates and their fasteners for securely holding the sponge and squeegee blade on the head.

These and other objects are accomplished by a window cleaning device with a head including a pair of oppositely facing securing plates. The plates are identical and can be manufactured using one die setup. The plates each have an elongated horizontal portion defining opposing longitudinally disposed edges. One edge of the plate terminates in an extension having a radial cross section for engaging the sponge. The other edge of the plate is L-shaped or V-shaped in cross section for engaging the squeegee blade. Each of the plates has an inner side and an outer side. When the plates are longitudinally aligned with their inner sides abutting, and fastened together for instance by rivets or the like, the radial extensions at a longitudinal edge of the plates provide an essentially C-shaped clamp for securing an elongated sponge to the head portion by compressing the sponge at a space from a longitudinal edge of the sponge. The L or V-shaped extensions at the opposite longitudinal edge of the head plates provide a clamp defining an essentially rhomboidal or diamond-shaped channel. The channel accepts and secures a squeegee blade, made of rubber or leather or another resilient material, and having a foundation spline which is essentially rhomboidal or diamond shaped in cross section, preferably integral with the blade. The blade extends approximately parallel to one of the faces of the rhomboid or diamond. A hollow tube, adapted for coupling with a cylindrical handle or pole or the like is affixed to the horizontal section of a plate for manual manipulation of the sponge and/or squeegee. The device is easily manufactured in that the head plates are identical, whereby only one die is needed for manufacturing the device. No external pieces such as stiffeners or anchoring devices are required to secure the elongated sponge within the head section. The head plates are not made to a severe angle to achieve proper orientation of the squeegee blade because the unique design of the blade, and in particular the rhomboidal or diamond shaped integral foundation and the disposition of the blade along a face of the foundation, properly sets the angle of the blade when the blade is clamped between the L or V-shaped extensions of the head plates.

A number of variations and further embodiments are also possible and several examples are discussed in connection with the particular embodiments as shown in the drawings and following detailed description.

BRIEF DESCRIPTION OF THE DRAWINGS

For better understanding of the invention, reference may be had to certain examples and preferred embodiments thereof, shown in the accompanying drawings and in which.

DETAILED DESCRIPTION OF THE PREFERRED EMBODIMENTS

The invention is a manual window cleaning device of the type having a handle and a head, the head securing one or both of a sponge and squeegee, between oppositely facing securing plates. The securing plates are substantially identical, having an inner and an outer wall, each of the plates defining a portion of a clamping means whereby the plates engage the sponge and/or squeegee. When the plates are longitudinally aligned and fastened together at their respective walls, the clamping means on one side of the head apply pressure to a section of the sponge spaced from a longitudinal edge of the sponge, thereby trapping and securing the sponge to the head. The clamping means on the opposite side of the head includes a shaped channel for receiving a squeegee blade having a foundation channel fitted complementarily in the channel and arranged such that the squeegee blade protrudes at an advantageous angle for application to a pane of glass or other smooth surface.

Figure 1:
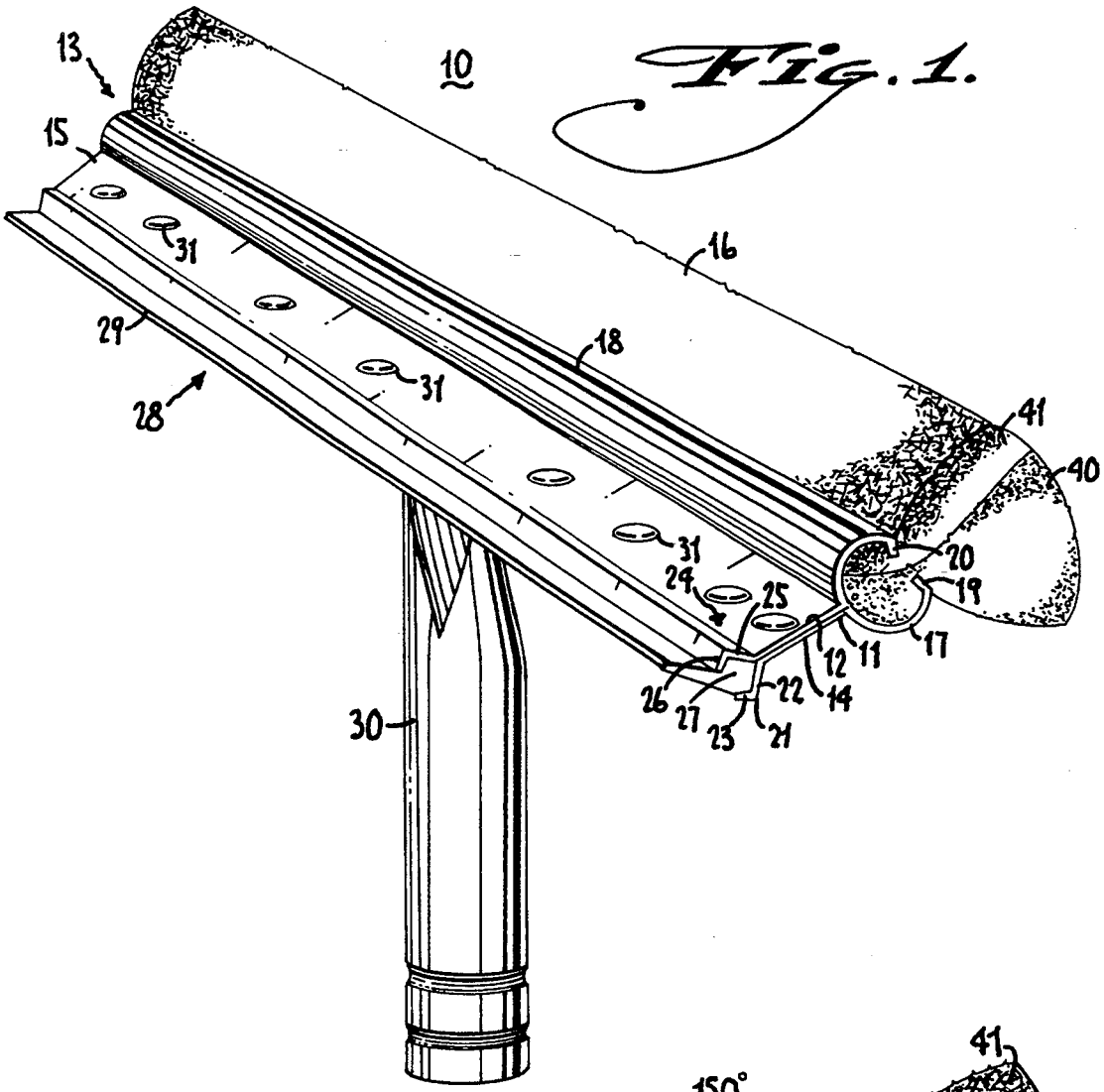
FIG. 1 is a perspective view of the window cleaning device of the invention.

As shown in FIG. 1, window cleaning device 10 has bottom plate 11 and top plate 12, attached together to form head 13 of window cleaning device 10. Bottom plate 11 has lower horizontal section 14. Top plate 12 has opposing upper horizontal section 15. Complementary extensions on one side secure the sponge, and on the other side secure the squeegee.

The sponge is useful for application of soapy water or other cleaning liquid to a glass surface, and to scrub the surface to be cleaned to remove encrusted dirt. Preferably, sponge 16 has a more absorbent section 40 and a rougher scrubbing section 41. Absorbent section 40 is a relatively soft sponge material adapted to absorb and hold liquid for application to a window pane or the like. Scrubbing section 41 is made of a tough coarse material such as a relatively stiff foamed polymer, the surface cells of which help to tear encrusted dirt, dead insects or other material off a window or the like. Sponge 16 is secured to head 13 within a C-shaped channel formed by the opposed lower radial extension 17 of lower horizontal section 14 of bottom plate 11 and upper radial extension 18 of upper horizontal section 15 of top plate 12. The C-shaped channels encompass an edge of the sponge, which expands within the space defined by the channels. The maximum clamping force holding sponge 16 to head 13 is provided at lower vertical lip 19, integral to lower radial extension 17, and upper vertical lip 20 integral to upper radial extension 18, where the greatest compression of the sponge occurs.

After applying soapy water, another cleaning solution or rinse water to the surface to be cleaned such as window or car windshield, and typically after some scrubbing of the window or windshield using sponge 16, it is necessary to remove the dirty water or cleaning liquid. A squeegee is used for such removal, forming a watertight barrier which is moved over the glass surface to sweep away the liquid. For this reason, the squeegee is preferably constructed of rubber, leather or a similar pliant material having a smooth, straight edge. The squeegee is drawn horizontally across the top portion of a pane of glass, proceeding in successive horizontal passes downwardly to remove all dirty water or cleaning liquid from the glass surface. Alternatively, the squeegee can be passed in laterally spaced vertical strokes.

Figure 2:
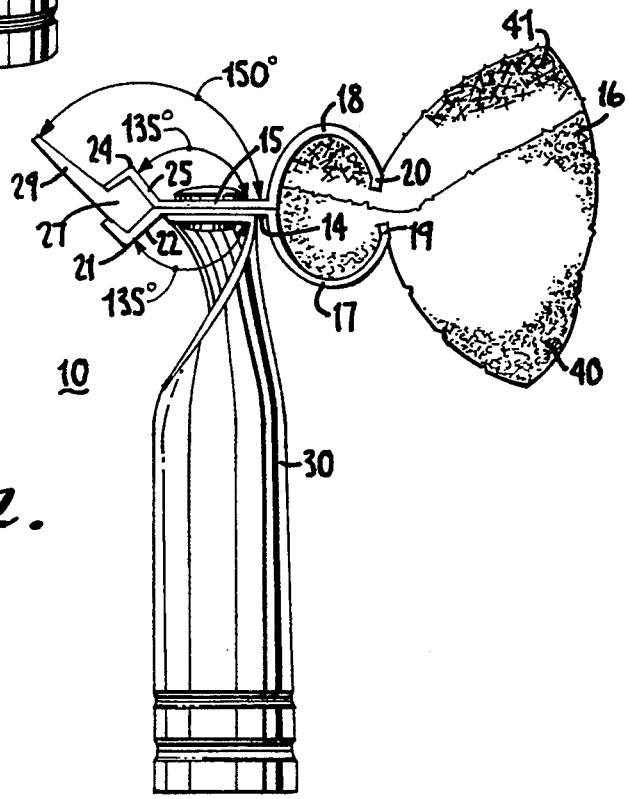
FIG. 2 is a side section view of the window cleaning device of the invention.

The two securing plates of head 13 define a rhomboidal or diamond shaped channel in cross section, for securing the complementarily shaped rhomboidal foundation 27 of the squeegee 28. The rhomboidal channel is formed by an L-shaped extension to each of lower horizontal section 14 and upper horizontal section 15. As shown in FIG. 2, lower horizontal section 14 has an essentially L-shaped or V-shaped extension 21. L or V-shaped extension 21 is formed of lower stem 22 and lower lip 23. Upper horizontal section 15 has an opposing L or V-shaped extension 24 formed by upper stem 25 and upper lip 26.

Lower L or V-shaped extension 21 and upper L or V-shaped extension 24 together define a rhomboidal or diamond shaped channel that not only secures squeegee 28 by its rhomboidal or diamond shaped foundation 27, but also orients the blade portion of the squeegee at the correct angle. Squeegee 28 has squeegee blade 29 for providing a liquid tight barrier when pressed against a smooth surface such as glass, to remove liquid. Handle extension 30 is fastened to lower horizontal section 14 of bottom plate 11. Handle extension 30 is adapted to couple with an elongated cylindrical handle (not shown) for manual manipulation of window cleaning device 10 across a dirty surface. The handle extension can be threaded or otherwise coupleable to the handle.

The user typically holds the handle approximately parallel to the surface to be wiped. The most effective removal of water or other liquid from a smooth surface such as glass requires that squeegee blade 29 be properly angled with respect to the surface. It has been found that for best results the squeegee blade should be angled away from the direction it is drawn across a surface for proper removal of liquid from the surface, preferably at an angle of approximately 150° relative to horizontal section 15 of top plate 12.

Preferably, the blade of the squeegee protrudes approximately along the plane defined by a side of the rhomboidal or diamond shaped foundation of the squeegee, or slightly outwardly from this plane. The approximate 150° angle of squeegee blade 29 is obtained by aligning the walls of L or V-shaped extensions 21 and 24, and the angle at which the blade protrudes from the foundation, to define this angle. It would also be possible to provide a different angular arrangement between the squeegee blade and the foundation, however the arrangement shown results in a minimal angular deviation in the clamping plates, and places the blade at the orientation needed. In accordance with the invention, it has been found that the proper angle for squeegee blade 29 can be achieved by angling lower stem 22 135° relative to lower horizontal section 14 of bottom plate 11. Lower lip 23 is disposed at essentially a right angle to lower stem 22. Similarly, upper stem 25 is angled 135° relative to upper horizontal section 15 of top plate 12. Upper lip 26 is disposed at essentially a right angle to upper stem 25. A squeegee blade 29 having a rhomboidal or diamond shaped foundation 27 as disclosed in the invention will, when secured within the rhomboidal or diamond shaped channel formed by lower L or V-shaped extension 21 and upper L or V-shaped extension 24 be disposed at an angle approximating 150° ensuring adequate removal of liquid from a glass or other surface. Accordingly, in the preferred arrangement the squeegee blade deviates from the plane of the foundation by about 15°.

Figure 3:
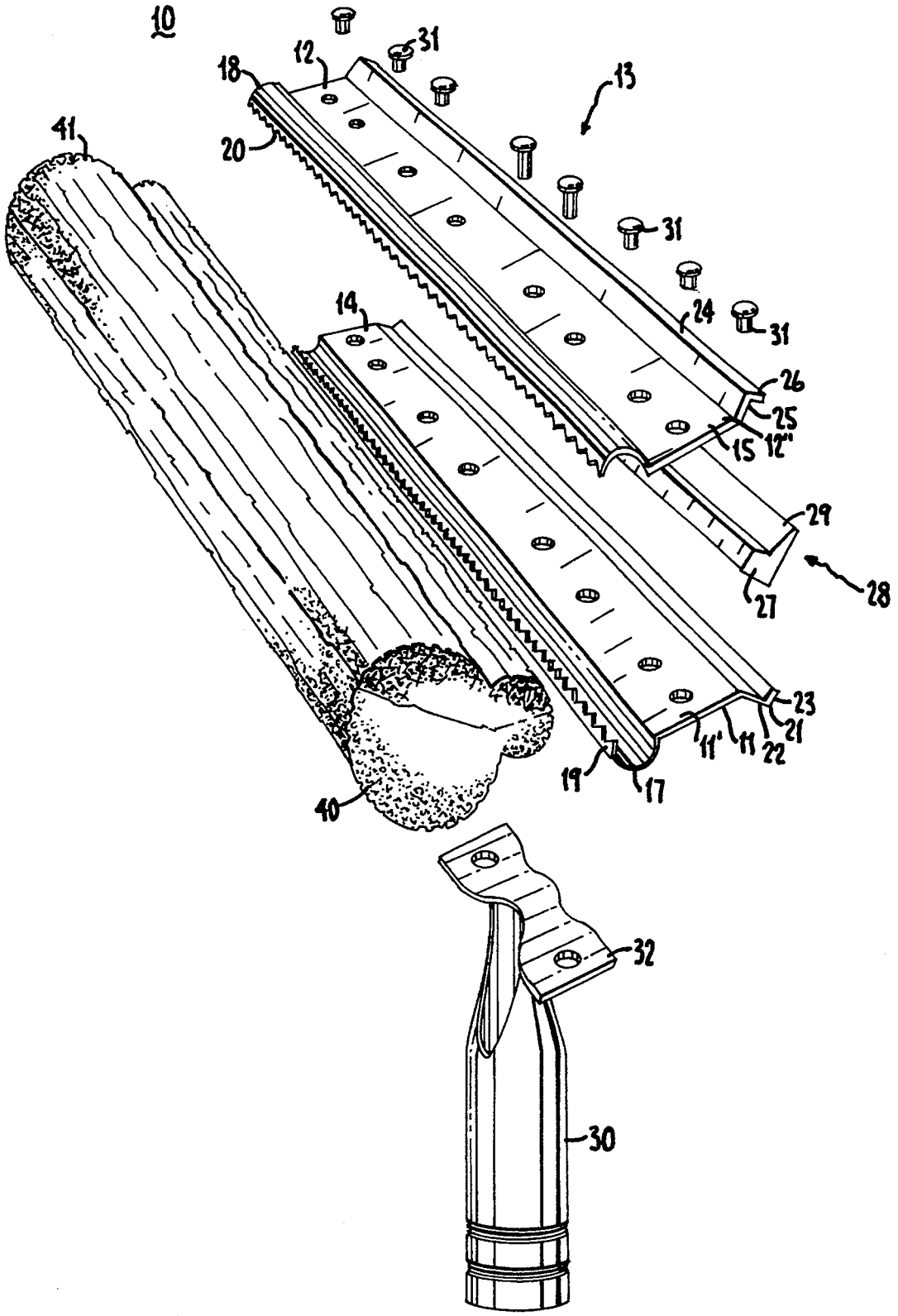
FIG. 3 is an exploded perspective view of the window cleaning device of the invention.

FIG. 3 shows an exploded perspective view of window cleaning device 10. As is clearly seen in FIG. 3, bottom plate 11 and top plate 12 are identical pieces. Window cleaning device 10 of the invention, therefore, is easily and inexpensively manufactured as compared to prior art designs since only one die is necessary to make the main component of the device, namely the head 13. In the event the plates are extruded shapes, only one extrusion die is required. If the plates are formed by bending flat stock using a press brake, only one die setup is needed. Bottom plate 11 and top plate 12 can be successive lengths of the formed stock, simply flipped over and fastened together with the handle portion on the sponge and squeegee to form head 13.

As shown in the exploded view of FIG. 3, bottom plate 11 has inner side 11' facing upward and an outer side 11'' (not shown) facing downward. Top plate 12 has outer side 12'' facing upward and an inner side 12' (not shown) facing downward. Inner side 12' opposes inner side 11' of bottom plate 11. As noted above, bottom plate 11 has lower radial extension 17 and, preferably, lower vertical lip 19 extending the full length of a longitudinal edge of lower horizontal section 14 of bottom plate 11. Similarly, top plate 12 has upper radial extension 18 and preferably upper vertical lip 20 extending from a longitudinal edge of upper horizontal section 15 top plate 12.

The opposing longitudinal edge of horizontal section 14 of bottom plate 11 has a lower L or V-shaped extension 21 along the full length of the longitudinal edge. As noted above, L or V-shaped extension 21 is formed by lower stem 22 and lower lip 23. An opposing longitudinal edge of upper horizontal section 15 of top plate 12 has upper L or V-shaped extension 24 formed by upper stem 25 and upper lip 26.

To assemble window cleaning device 10, bottom plate 11 and top plate 12 are longitudinally aligned in a bottom plate inner side 11' to top plate inner side 12' relation. A sponge 16 or other component adapted to hold and apply liquid to a hard surface, as well as to withstand vigorous rubbing against the hard surface is positioned between bottom plate 11 and top plate 12. A portion of sponge 16 is positioned to completely reside within the C-shaped channel formed by lower radial extension 17 and upper radial extension 18.

The rhomboidal or diamond shaped foundation 27 of squeegee 28 having squeegee blade 29 is aligned to reside within a rhomboidal or diamond shaped channel formed by lower L or V-shaped extension 21 and upper L or V-shaped extension 24. Bottom plate 11 and top plate 12 are longitudinally aligned and fastened inner bottom plate 11' to top plate inner size 12' The plates are preferably fastened using inner side rivets 31. The bringing together and fastening of bottom plate 11 to top plate 12 causes lower radial extension 17 and upper radial extension 18 and preferably lower vertical lip 19 and upper vertical lip 20 to clamp upon sponge 16 exerting opposing upward and downward forces to immovably secure sponge 16 to head 13. Two of the more central rivets also engage the flange plate 32 of handle 30.

In order to provide a better grip on sponge 16, lower vertical lip 19 and upper vertical lip 20 can have serrated edges for slightly piercing and gripping sponge 16. The serrations can be formed when the plates are cut from flat stock, the stock thereafter being bent to form the respective channels. The serrations can be provided an extreme edge bend of the C-shaped channels that orients the serrations perpendicular to the center plane of the sponge.

In like manner, lower L or V-shaped extension 21 and upper L or V-shaped 24 come together to form a rhomboidal or diamond shaped channel encompassing rhomboidal or diamond shaped foundation 27 of squeegee 28. Squeegee 28 is thus securely held by head 13. Furthermore, squeegee blade 29 is disposed at the optimal angle for removal of liquid from a hard surface by the geometry of L or V-shaped extension 21, upper L or V-shaped extension 24 and rhomboidal or diamond shaped foundation 27.

Handle extension 30 can be affixed in a number of ways, but preferably is simply riveted, to the two plates using two of the rivets passed through the plates. Handle extension 30 is adapted to accept a handle for manually manipulating the window cleaning device 10 over a dirty window or the like, for example being threaded via helical indentations in the material of handle extension 30.

While specific exemplary embodiments of the invention have been described in detail, it will be appreciated that those skilled in the art will now be aware of various modifications and alternatives within the scope of the invention in light of the overall teachings of this disclosure. For example, it is taught to use rivets 31 to secure bottom plate 11 to top plate 12 and handle attachment 30 to bottom plate 11. However, it is within the scope of the invention to use nuts and bolts or other known fastening devices or methods. The lower and upper stems 22 and 25 are disclosed to reside at angles of approximately 135° relative to bottom plate 11 and top plate 12 respectively, to dispose squeegee blade 29 at an angle of 150° relative to top plate 12. These angles are not limiting and other angles are possible to align squeegee blade 29 at an advantageous angle for particular uses or users. Accordingly, the particular arrangements disclosed are meant to be illustrative only and not limiting as to the scope of the invention which is to be given the full breath of the appended claims and any and all equivalents thereof.

What is claimed is:

1. A window cleaning device of the type having a head to be secured on a handle, the head securing a sponge means and a squeegee blade means, the head comprising:

a pair of oppositely facing securing plates, said plates being substantially identical, said plates each having an inner and an outer wall, each of said plates having an essentially horizontal section, each of said horizontal sections having laterally disposed edges, one of said laterally disposed edges on each of said horizontal sections being a sponge clamping edge terminating in a radial section, each of said radial sections terminating in a longitudinal edge for providing a clamping means and essentially defining a C-shaped cross-section when said plates are longitudinally aligned with respect to each other and fastened together at their respective inner walls, thereby clamping and securing a sponge to said head, said radial sections oppositely facing thereby providing a cavity for holding a portion of the clamped sponge, an opposite of said laterally disposed edges on each of said horizontal sections is a squeegee blade edge defining a squeegee blade holding means.

2. The device of claim 1, wherein each said radial section is essentially semi-circular.

3. The device of claim 1, further comprising an essentially vertical lip disposed at said termination of each of said radial sections, said vertical lips providing said clamping means.

4. The device of claim 1, further comprising an essentially L-shaped shoulder disposed at said squeegee blade edge of said horizontal section of each of said plates, said L-shaped shoulders of the plates oppositely facing when said plates are fastened together to provide said squeegee blade holding means.

5. The device of claim 4, wherein said L-shaped shoulders comprise a stem and a lip, said stem depending from said squeegee blade edges of said horizontal sections of said plates at an angle of approximately b 135° relative to said horizontal sections.

6. The device of claim 5, wherein said L-shaped shoulders of said plates essentially define a rhomboid when said plates are fastened together at their respective inner walls.

7. The device of claim 6, further comprising a squeegee blade having a foundation essentially rhomboidal in cross-section, said foundation being disposed within said squeegee blade holding means comprised of said oppositely facing L-shaped shoulders when said plates are fastened together at their respective inner walls.

8. The device of claim 7, wherein said squeegee blade has a wiper portion integral with said foundation, said wiper portion disposed at an angle of essentially 150° relative to said horizontal section of said plates.

9. The device of claim 5, wherein said L-shaped shoulders of said plates essentially define a diamond when said plates are fastened together at their respective inner walls.

10. The device of claim 1, further comprising rivets fastening said plates together.

11. The device of claim 1, further comprising a hollow cylindrical tube having a mount disposed essentially perpendicular to said tube, said mount affixed to an outer wall of one of said plates, said cylindrical tube adapted to accept the handle.

12. A window cleaning device of the type having a handle, comprising:

a bottom plate having an elongated horizontal section, an inner side and an outer side, said horizontal section having a sponge edge and a squeegee edge, said sponge edge having an essentially upward curving radial extension defining a lower sponge clamping means, said squeegee edge having lower squeegee clamping means;

a top plate identical to said bottom plate, having an elongated horizontal section, an inner side and an outer side, said horizontal section having a sponge edge and a squeegee edge, said sponge edge having an essentially downward curving radial extension defining an upper sponge clamping means, said squeegee edge having upper squeegee clamping means wherein said bottom plate and said top plate are longitudinally aligned and fastened together at said respective inner sides, said radial extensions essentially defining a C-shaped cross-section for clamping a sponge within said lower and upper sponge clamping means, a squeegee blade being clamped within said lower and upper squeegee clamping means.

13. The device of claim 12, further comprising an essentially vertical lip disposed on an end of each of said radial extensions, said lips providing improved clamping force.

14. The device of claim 12, wherein said lower squeegee clamping means is an essentially upward facing L-shaped cross sectional shoulder and said upper squeegee clamping means is an essentially downward facing L-shaped cross sectional shoulder.

15. The device of claim 14, wherein said L-shaped shoulders essentially provide an elongated cavity, rhomboidal in cross-section, for clamping a squeegee blade having a base essentially rhomboidal in cross section.

16. The device of claim 15, wherein said squeegee blade has a wiper disposed at an angle of about 150° relative to each of said horizontal sections when said bottom and top plates are fastened together at said respective inner sides.

17. The device of claim 14, wherein said L-shaped shoulders essentially provide an elongated cavity, having a diamond shaped cross-section, for clamping a squeegee blade having a base essentially diamond shaped in cross-section.

18. The device of claim 14 wherein said L-shaped cross sectional shoulders have a stem and a lip, said stem of said upward facing L-shaped cross sectional shoulder depending from said squeegee edge of said bottom plate at an angle of about 135° relative to said bottom plate, said stem of said downward facing L-shaped cross sectional shoulder depending from said squeegee edge of said top plate at an angle of about 135° relative to said top plate.

* * * * *